United States Patent [19]

Wainess et al.

[11] Patent Number: 4,468,544

[45] Date of Patent: Aug. 28, 1984

[54] SWITCH LOCK

[76] Inventors: Anamae Wainess; William Wainess, both of 18354-A Collins, Tarzana, Calif. 91356

[21] Appl. No.: 517,017

[22] Filed: Jul. 25, 1983

[51] Int. Cl.[3] ..... H01H 9/20

[52] U.S. Cl. ..... 200/42 R; 200/322; 200/327

[58] Field of Search ..... 200/42 R, 42 T, 322, 200/323, 327, 334, 304; 74/529, 532; 220/241, 242

[56] References Cited

U.S. PATENT DOCUMENTS

| | | | |
|---|---|---|---|
| 1,448,105 | 3/1923 | Bell | 74/532 |
| 2,246,919 | 6/1941 | Krantz | 200/325 |
| 2,523,943 | 9/1950 | Choppa | 200/42 T |
| 2,810,050 | 10/1957 | Johnson | 200/328 |
| 2,946,864 | 7/1960 | Marien | 200/328 |
| 3,384,727 | 5/1968 | Zavertnik et al. | 200/323 |
| 3,816,677 | 6/1974 | Soltez | 200/42 T |
| 4,102,471 | 7/1978 | Lore et al. | 220/242 |

*Primary Examiner*—John W. Shepperd
*Attorney, Agent, or Firm*—Jack C. Munro

[57] ABSTRACT

A locking device to be mounted in conjunction with a switch arm. The locking device is to be moved between a locking position and a release position. The switch arm is to be movable between "on" position and "off" position. With the locking device is the locking position, the switch arm is prevented from movement from the "off" position to the "on" position. With the locking device in the release position, the switch arm is readily movable between the "on" and "off" position.

1 Claim, 5 Drawing Figures

SWITCH LOCK

REFERENCE TO PRIOR APPLICATION

This application is an improvement of the structure defined within now abandoned Patent Application, Ser. No. 946,596, filed Sept. 28, 1978, entitled Switch Lock.

BACKGROUND OF THE INVENTION

Electric lights for most homes are controlled by electrical switches which have a switch arm, finger operated to either an "on" or "off" position. Electrical heaters, garbage disposals and bathroom fans also use similar electrical switches. In most cases, there are no labels placed on the individual switches, whether they are located together or separately, so that it is difficult to know exactly which switch operates which motor, or a particular light. As the cost of electricity escalates, it is desirable that motors for equipment, such as garbage disposals, overhead heat lamps, bathroom fans, etc. and the like not be turned on accidentally when their use is not desired.

Also, in some cases, such as for a refrigerator connected to a switch, the position of the switch is "on" and it is not desired that the switch be accidentally moved to the "off" position. Previously, a strip of adhesive tape had been placed over the switch to hold it in the normal desired position, but this requires that the tape be removed when it is desired to move the switch arm. Also, the tape must be replaced after the operation of the controlled device is completed.

Other locking devices have been utilized to hold the switch arm in a pre-selected position, as evidenced by prior art patents. Disclosed in U.S. Pat. No. 2,523,943 to John T. Choppa, is a device for use with electrical switch arms of the pivoted type which holds the switch arm in either its "on" or "off" position to prevent the operation of a switch by an unauthorized person. This device has a base plate which is attached to the face plate of the switch by one of the mounting screws for the face plate and the base plate has side flanges for mounting a pivot pin for a locking member. The locking member is urged into locking position by a spring around the pivot pin. The free end of the locking member engages the switch actuating arm. A similar structure is shown in U.S. Pat. No. 3,678,228 to Wayne D. Adamson, and utilizes a locking member pivoted on a support attached to the switch face plate and the locking member is spring-biased to hold the switch actuating arm in the "off" position. Also, U.S. Pat. No. 3,784,766 to Norman F. Johnson discloses a spring-biased bail which prevents the accidental actuation of a switch. Other U.S. patents of interest are Wiess, U.S. Pat. No. 2,192,060; Machete, U.S. Pat. No. 2,937,248; Schmidt, U.S. Pat. No. 2,141,936; and Buturuga, U.S. Pat. No. 3,170,050.

SUMMARY OF THE INVENTION

The present invention provides a locking device for a switch actuating arm which is much simpler than prior devices and much less complicated to install and operate. The switch actuating arm extends through an opening in a face plate which is used to cover the switch mechanism. The face plate is attached to the switch mechanism by a pair of spaced-apart mounting screws. The locking device utilizes a latch arm which is mounted directly adjacent the face plate by one of the mounting screws. The free end of the latch arm is normally positioned to prevent movement of the switch arm. The free end is smoothly contoured forming a cam surface so the latch arm will easily slide over the switch actuating arm if the locking device comes into contact with the switch actuating arm. The latch arm is spaced from the face plate by a washer. The mounting screw passes through the back end of the latch arm, through the washer and through the face plate. The washer supports the latch arm for rotation about the mounting screw and holds the latch arm away from the surface of the switch plate. A portion of the washer flares outwardly during tightening of the mounting screw to establish a frictional fit between the washer or the latch arm. When the latch arm is rotated from its locking position, the switch arm can be moved between its "on" and "off" positions.

In order to install the locking device on the face plate, it is only necessary to remove one face plate mounting screw and replace it with a screw of the same diameter which is long enough to pass through the latch arm, washer and face plate and thread into the same threaded hole within the electric switch mechanism. Thus, it is not necessary to provide a separate support plate for a locking member and to spring bias the locking member into locking position. The locking device of the present invention can be operated by one hand since the latch arm can be moved away from the switch arm before the switch arm is moved to actuate the switch with the same hand.

DESCRIPTION OF THE PREFERRED EMBODIMENT

Figure 1:
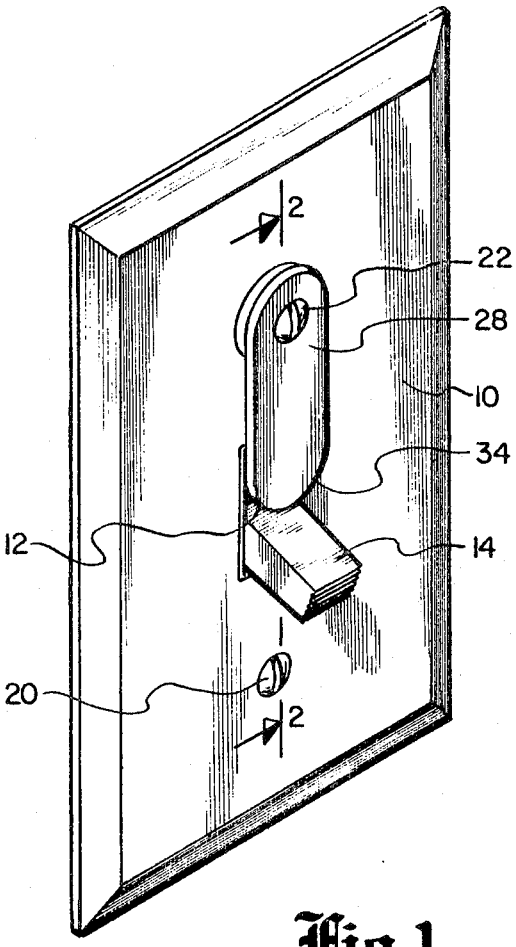
FIG. 1 is a front isometric view of the switch arm extending through the face plate and the latch arm located to prevent movement of the switch arm.

Referring to FIG. 1, there is shown a switch face plate 10, having a center opening 12, through which extends a switch arm 14. The arm 14 is connected to an electrical switch assembly 16. Arm 14 is pivotable between an "off" position shown in FIG. 1 to an "on" position shown in FIG. 5.

Switch assembly 16 is mounted on plate 18 which is secured to a supporting wall not shown. Normally, the plate 18 supports the face plate 10 by means of two screws 20 (only one shown) of equal length, which pass through openings in the face plate 10 and thread into the plate 18. A switch box (not shown) usually located in an opening in a wall, supports plate 18 and surrounds the switch assembly 16. The structure of the switch box, plate 18 and switch assembly 16 are well-known in the art.

Figure 2:
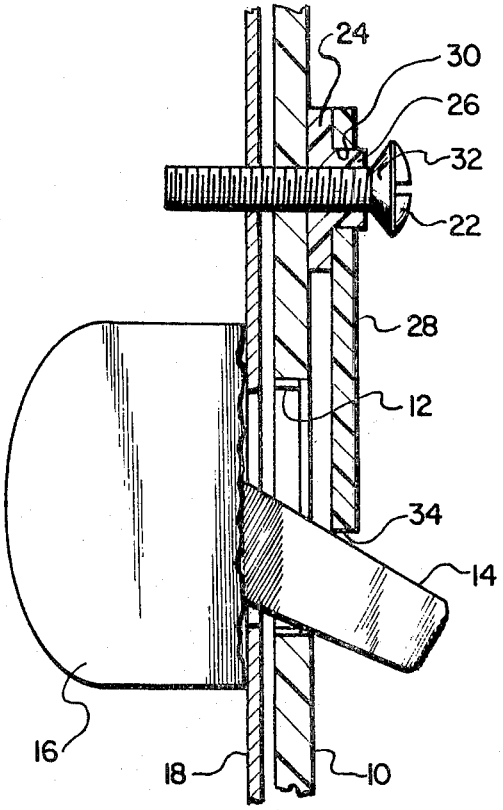
FIG. 2 is a cross-sectional view taken of FIG. 1 showing the mounting screw in the not fully installed position.
Figure 3:
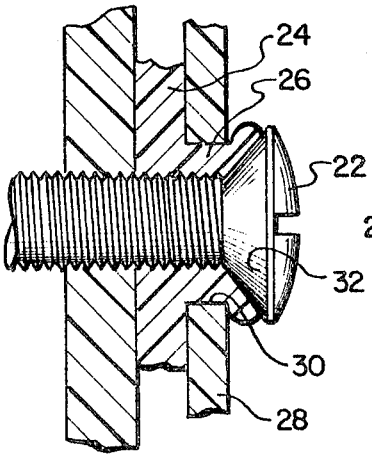
FIG. 3 is a cross-sectional view showing the mounting screw fully installed.

In the present invention, one of the screws 20 is removed and replaced with a longer screw 22 having the same diameter and shape of head. In FIG. 2, screw 22 is in the top opening of the face plate 10. The screw 22 passes through a plastic washer 24. The washer 24 includes a sleeve 26. A latch arm 28 has an opening 30 therein. Sleeve 26 is located within opening 30. It is to be noted that sleeve 26 protrudes exteriorly of latch arm 28. The protruding portion of the sleeve 26 is to come into contact with the annular beveled surface 32 of the screw 22. Upon tightening of the screw 22, the beveled surface 32 causes deformation of the protruding portion of the sleeve 26, which causes frictional resistance to result between the sleeve 26 and the latch arm 28. The more the screw 22 is tightened, the greater this frictional resistance. It is to be kept in mind that the latch arm 28 is to be pivotal on the sleeve 26. It is desired that this pivoting movement not be completely free and once the latch arm 28 is moved to a preset position, it will remain in that position. Therefore, by selecting the amount of tightening of the screw 22, the desired amount of frictional connection can be obtained. Also, as time goes on, and the latch arm 28 is used, a certain amount of looseness may occur. This looseness can be overcome by merely increasing the tightening of the screw 22, which increases the frictional resistance between the latch arm 28 and the sleeve 26.

The free outer end of the latch arm 28 is formed into a rounded cam surface 34. The lack of a sharp corner through the use of the rounded cam surface 34 is such that the latch arm 28 comes into contact with the switch arm 14, the latch arm 28 will merely ride across the switch arm 14 and insure that the switch arm 14 is located in the particular established position, as shown in FIG. 1 of the drawing. The switch arm 14 is not capable of being moved from the position it is in. In other words, if the switch arm 14 is in the off position, it is not capable of being moved to the on position and vice versa.

Figure 4:
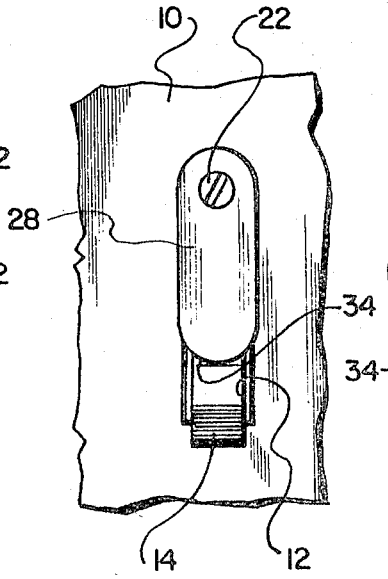
FIG. 4 is a front elevational view showing the latch arm in the locking position.
Figure 5:
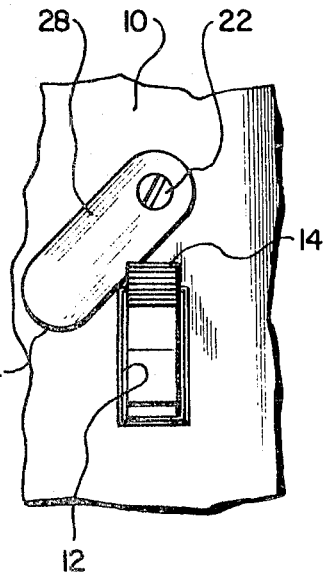
FIG. 5 is a view showing the latch arm pivoted to the release position.

When it is desired to pivotally move the switch arm 14 from the position shown in FIGS. 1, 2 and 4, is only necessary to pivot the latch arm 28 to one side of the switch arm 14. The switch arm 14 can then be moved to its other position as shown in FIG. 5 of the drawing.

It is considered to be within the scope of this invention to have the latch arm 28 fall automatically into the locking position of FIG. 1 of the drawing. In this particular situation, whenever the switch arm 14 is moved to the lowermost position as shown in FIG. 1, the latch arm 28 will then automatically pivot like a pendulum to the position shown in FIG. 1. This type of installation may be desirable in certain types of electrical equipment.

It is to also be understood that the latch arm 28 can be mounted in conjunction with the opening wherein the screw 20 is located. In this particular situation, the switch arm 14 would normally be maintained in the on position if the position shown in FIG. 1 is deemed to the off position. The type of appliance which would normally be desirable to keep running continuously, would be a refrigerator.

What is claimed is:

1. A switch arm locking device for preventing movement of a switch arm projecting through an opening in a switch face plate, said face plate having openings for mounting screws for securement to a plate supporting a switch assembly, said locking device comprising:

a washer having one side located against said face plate;

a sleeve attached to said washer and extending therefrom;

a washer opening formed in said washer and sleeve in alignment with one of said mounting screw openings in said face plate;

a mounting screw extending through said one mounting screw opening in said sleeve and said washer opening for supporting such on said face plate;

a latch arm pivotally mounted against the other side of said washer, said latch arm having a latch arm opening, said sleeve being located within said latch arm opening, said latch arm having a free outer end, said free outer end being rounded forming a cam surface, said latch arm being pivotal to a release position permitting movement of said switch arm from its established position; and said sleeve extending exteriorly of said latch arm, tightening of said mounting screw causes deformation of said sleeve into frictional contact with said latch arm, increasing tightening of said screw increases the frictional connection between said latch arm and said sleeve.

* * * * *